US005879022A

United States Patent [19]

Winton

[11] Patent Number: 5,879,022

[45] Date of Patent: Mar. 9, 1999

[54] CONVERTIBLE GOLF CART AND BAG DEVICE AND METHOD OF CONVERTING SAME

[76] Inventor: Harry D. Winton, 6890 Alani Ct., North Port, Fla. 34287

[21] Appl. No.: 933,808

[22] Filed: Sep. 19, 1997

[51] Int. Cl.[6] ..... B62B 1/14

[52] U.S. Cl. ..... 280/655; 280/47.26; 280/652; 280/655.1; 280/DIG. 6

[58] Field of Search ..... 280/DIG. 6, 47.26, 280/652, 655, 655.1; 301/124.1; 74/607

[56] References Cited

U.S. PATENT DOCUMENTS

| | | | |
|---|---|---|---|
| D. 302,886 | 8/1989 | Padilla | D34/15 |
| 2,613,952 | 10/1952 | Lannon | 280/DIG. 6 |
| 2,731,182 | 1/1956 | Higgins | 280/DIG. 6 |
| 2,732,218 | 1/1956 | Resch | 280/DIG. 6 |
| 2,868,559 | 1/1959 | Vincelette | 280/DIG. 6 |
| 4,400,006 | 8/1983 | Larkin | 280/646 |
| 4,550,930 | 11/1985 | Proffit | 280/655 |
| 4,822,071 | 4/1989 | Widegren | 280/646 |
| 4,832,362 | 5/1989 | Chen | 280/645 |
| 4,911,465 | 3/1990 | Haner | 280/646 |
| 5,071,147 | 12/1991 | Stansbury | 280/DIG. 6 |
| 5,125,507 | 6/1992 | Graziano, Jr. | 280/DIG. 6 |
| 5,265,894 | 11/1993 | Dunn | 280/DIG. 6 |
| 5,267,750 | 12/1993 | Thompson | 280/DIG. 6 |
| 5,632,496 | 5/1997 | Nelson | 280/DIG. 6 |

*Primary Examiner*—D. Glenn Dayoan
*Assistant Examiner*—Clovia Hamilton
*Attorney, Agent, or Firm*—Charles W. Chandler

[57] ABSTRACT

A device and method for converting a golf bag to a golf cart. The device has a hardside rectangular shaped main portion. The bottom is canted with a plate having a connector for a removable axle. The axle is locked but can be attached or removed as desired. The top has tubing for receiving the clubs, accessories, and the axle when detached from the connector. Wheels can be joined to the axle or else stored in internal storage compartments within the device. A cover having zippered access to the clubs extends above the device. When opened, the cover falls to the side, out of the way.

2 Claims, 1 Drawing Sheet

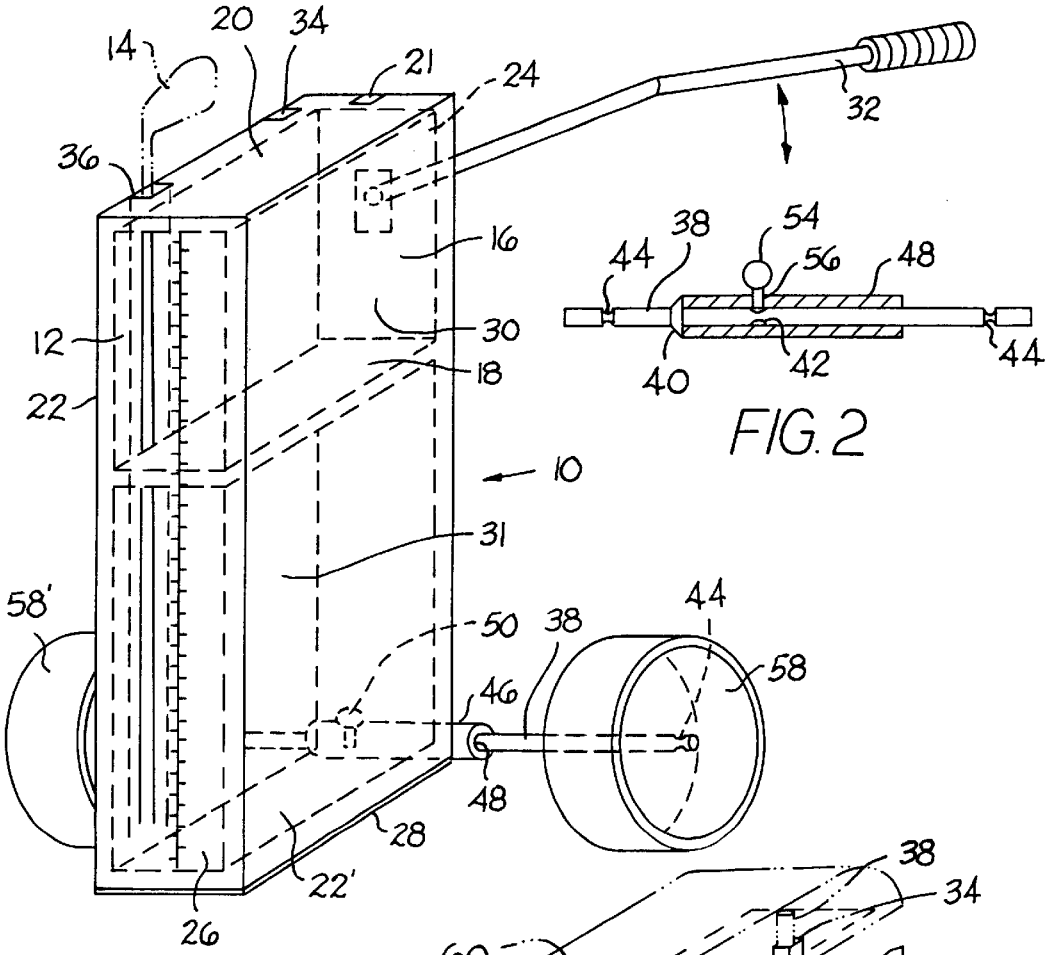
FIG. 1
FIG. 2
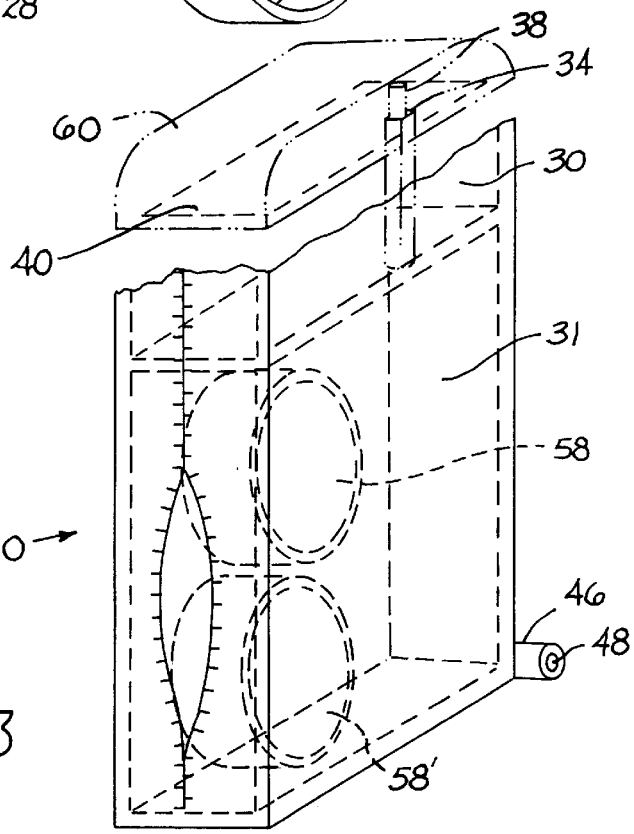
FIG. 3

CONVERTIBLE GOLF CART AND BAG DEVICE AND METHOD OF CONVERTING SAME

BACKGROUND OF THE INVENTION

The field of the invention pertains to the sport of golfing. In particular, the invention pertains to a device for carrying golf clubs and accessories that can be converted to a combination golf bag and cart, and to the method of converting of the device into a golf cart.

Typically, a golf bag is either carried by the player, mounted on a pull cart or placed on a power riding cart. Pull carts are usually foldable. However, when a bag with a folded pull cart is mounted onto a power cart, undesirable effects can be realized. For example, the bag is tipped at an awkward angle although strapped to the power cart.

A disadvantage of mounting a golf bag with an attached pull cart to a power cart is that easy access to the golf bag is limited. If a ball or tee is needed, the pull cart often blocks access to the appropriate location on the golf bag.

Moreover, when traveling, it is convenient to have a golf cart accessible for immediate use, such as when the clubs arrive on a luggage carousel at an airport. The search for a porter to load the golf bag, or carrying the golf bag while carrying other luggage is an annoyance.

Most known golf carts that attach to a bag are useful but bulky. Although the need for a device to carry a golf bag, yet which can be readily stowed existed, I am unaware of any such device.

Examples of the known art are shown in the following U.S. Pat. Nos. 4,400,006 to Larkin for a golf bag provided with a retractable rolling assembly; 4,550,930 to Proffit for a golf caddy; Des. 302,886 to Padilla for a caddy for golf clubs and beverage containers; 4,911,465 to Hauer for golf club container with extensible wheels; 4,822,071 to Widegren for a golf bag unit having extendible and retractable traveling wheels; and 4,832,362 to Chen for a golf bag cart.

The Larkin patent discloses a device that extends from the side of a golf bag and is locked in position. The Proffit patent shows a device that attaches to an existing golf bag. The Padilla patent teaches a design for a golf bag having a seat and a holder for a beverage. The Hauer patent shows a device having foldable wheels stored internally in the device but with the wheels remaining on the folding structure. The Widegren patent shows extendible and retractable traveling wheels which remain attached to the support legs. The Chen patent discloses wheels attached to arms having shock absorbers. The wheels remain attached to the arms as the arms are folded up against the outside of the bag. Although these patents show storage of wheels on a golf bag, most of the wheels remain attached to the structure. None of these patents show detachable wheels and the mounting structure which can be stored within the device itself.

SUMMARY OF THE INVENTION

It is an object of the invention to provide a convertible device that can be readily converted from a wheel-less golf bag to a wheeled golf bag.

It is an object of the invention to provide a convertible device that allows the wheels and axle of the golf cart to be easily and completely stored within the golf bag.

It is also an object of the invention to provide a cover to the golf bag which is easily removable for access to the clubs.

The invention comprises a device for converting a wheel-less golf bag to a golf bag with a golf cart. The conversion is accomplished in a convenient and quick manner.

The inventive device has a housing with a top, sides and a canted bottom. A foldable handle is attached to the back of the device for pulling the golf bag with if it's cart. The top of the housing has tubing for receiving golf clubs and accessories such as an umbrella and the axle, as will be explained. The tubing can have a square cross-section.

Several internal storage compartments are disposed in the housing. The storage compartments are useful for traditional golf bag storage purposes.

Sheathing of fabric or plastic material surrounds the housing. Zippers provide access to the storage compartments.

A tube is positioned along the bottom of the housing. An axle is positioned in the tube. The axle is then locked in position by a turn-screw fitting into a tapered hole on the axle. Wheels are mounted on each end of the shaft.

The wheels are removable and are stored in the housing. The axle is removed by releasing the lock and withdrawing the axle from the tube. Thereafter, the axle is stored within a tube at the top of the device. Thus, the conversion of the wheel-less golf bag into a golf bag with cart is quickly accomplished. Reconverting the golf bag with cart back to a wheel-less golf bag is also quickly accomplished.

For a more complete understanding of the present invention, reference is made to the following detailed description when read in conjunction with the accompanying drawings wherein like reference characters refer to like elements throughout the several views, in which:

BRIEF DESCRIPTION OF THE DRAWINGS

The description refers to the accompanying drawing in which like reference characters refer to like reference parts throughout the several views, and in which:

FIG. 1 illustrates a perspective view of the preferred embodiment of the invention having removable axle and wheels mounted in the golf bag;

FIG. 2 illustrates a side view of the axle; and

FIG. 3 illustrates a perspective view of the invention having the removable axle and wheels stored within the golf bag.

DESCRIPTION OF THE PREFERRED EMBODIMENT

FIGS. 1, 2, and 3 show a convertible golf bag apparatus generally denoted as 10. Apparatus 10 is a device 12 for holding golf clubs 14 (shown in phantom), and usually referred to as a golf bag 16. The device 12 comprises a main housing 18 having a top 20, sides 22, 22', a back 24, a front 26 and a canted bottom 28, which create compartments 30, 30'. A folding handle 32 is attached to back 24 of the golf bag.

As is shown in FIG. 1, top 20 has apertures 21, 21', etc. for the placement of open-top tubes 34, 34', etc. Tubes 34, 34', etc. each has a square shape 36. Sixteen pieces of tubing provide storage for a full set of clubs, an umbrella and for storing a removable axle 38.

Axle 38 is better shown in FIG. 2 as having a stop 40 and an annular slot 42. A groove 44 is provided at each end of axle 38. Axle 38 is shown as mounted on golf bag 16 in a tube 48 attached to the canted bottom 28 of housing 18. Tube 48 runs lengthwise along the back 24 and canted bottom 28. Axle 38 is inserted into tube 48 until a stop 40 on the axle engages the end of tube 48. Axle 38 is then locked in position by a locking turnscrew 54 fitting through a hole 56 in tube 48 and into the annular slot 42 on axle 38. Removable lockable wheels 58, 58' are mounted on the groove 44 at each end of axle 38.

FIG. 3 shows wheels 58, 58' and axle 38 removed from the exterior of the housing and stored in one of the compartments 30,31 of the housing. Zippered access opening 62 in housing front wall 26 permits the wheels to be manually inserted into compartment 31 or removed therefrom, as shown generally in FIG. 3. Axle 38 is stored in one of the tubes 34 at the top 40 of the device. A cover 60 (shown in phantom) protects the clubs and the top of device 12. Cover 60 is especially useful for shipping the device 12. The cover drops to the side when opened to allow access to the top 20 of device 12.

Having described my invention, many modifications thereto will become apparent to those skilled in the art to which it pertains without deviation from the spirit of the invention as defined in the appended claims.

I claim:

1. A convertible golf bag comprising:

a housing having a bottom wall (28), back wall (24), front wall (26), and two spaced-apart side walls (22, 22') extending between said back wall and said front wall;

plural golf club storage compartments (34, 34') located within said housing along said back wall and both side walls;

a zippered access opening in said housing front wall;

an axle support tube (48) secured to said housing at the juncture between said bottom wall and said back wall; said support tube extending normal to said side walls;

an externally accessible set screw (54) threaded into said axle support tube;

an axle (38) adapted for insertion into said support tube to have an operating position wherein said axle has two exposed end portions of equal length;

said axle having an abutment (40) for limiting insertional movement of the axle to its operating position, whereby said set screw can then be manually tightened to lock said axle to said support tube; and ground wheels detachably mounted on the exposed end portions of said axle; and said ground wheels being adapted for manual insertion through said zippered access opening into stored positions within said housing; said axle being removable from said support tube for storage in said housing.

2. The convertible golf bag of claim 1, and further comprising an annular groove (42) in said axle; said groove being aligned with said set screw when the axle is in its operating position, whereby the set screw can seat in said groove.

* * * * *